US009483947B2

(12) United States Patent
Strassberger

(10) Patent No.: US 9,483,947 B2
(45) Date of Patent: Nov. 1, 2016

(54) PASSING ASSISTANCE SYSTEM AND METHOD

(71) Applicant: Bayerische Motoren Werke Aktiengesellschaft, Munich (DE)

(72) Inventor: Markus Strassberger, Wartenberg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/472,864

(22) Filed: Aug. 29, 2014

(65) Prior Publication Data

US 2015/0061894 A1 Mar. 5, 2015

(30) Foreign Application Priority Data

Sep. 2, 2013 (DE) ..... 10 2013 217 434

(51) Int. Cl.
*G08G 1/16* (2006.01)
*G08G 1/017* (2006.01)

(52) U.S. Cl.
CPC ..... *G08G 1/166* (2013.01); *G08G 1/017* (2013.01); *G08G 1/161* (2013.01); *G08G 1/163* (2013.01); *G08G 1/167* (2013.01)

(58) Field of Classification Search
CPC .... G08G 1/0965; G08G 1/0967; G08G 1/09; G08G 1/16; G08G 1/161; G08G 1/166; G08G 1/167; G08G 1/017; G08G 3/02; G08C 17/02; B60W 30/08; G01C 21/26
USPC ..... 340/901, 903, 905, 435; 701/23, 28, 36, 701/117
See application file for complete search history.

(56) References Cited

U.S. PATENT DOCUMENTS

| | | | | |
|---|---|---|---|---|
| 7,133,768 | B2 * | 11/2006 | Mukaiyama | G08G 1/161 340/435 |
| 7,181,343 | B2 | 2/2007 | Mukaiyama | |
| 8,886,386 | B2 * | 11/2014 | Merk | G08G 1/161 340/905 |
| 2007/0293996 | A1 * | 12/2007 | Mori | G01C 21/005 701/23 |
| 2008/0027607 | A1 | 1/2008 | Ertl et al. | |
| 2008/0291052 | A1 * | 11/2008 | Burns | G08G 1/164 340/903 |
| 2009/0140887 | A1 * | 6/2009 | Breed | G01C 21/165 340/990 |

(Continued)

FOREIGN PATENT DOCUMENTS

| | | | |
|---|---|---|---|
| DE | 103 56 500 | A1 | 7/2004 |
| DE | 103 10 501 | A1 | 9/2004 |
| DE | 10 2004 019 337 | A1 | 11/2005 |

(Continued)

OTHER PUBLICATIONS

German Search Report dated Feb. 18, 2014, including English translation (ten (10) pages).

*Primary Examiner* — Hung T Nguyen
(74) *Attorney, Agent, or Firm* — Crowell & Moring LLP

(57) ABSTRACT

A passing assistance system and method is provided for one's vehicle having an electronic control device for at least receiving messages from car-to-car communication systems of other vehicles. The messages include information about the presence or absence of a vehicle that trails the vehicle transmitting the message. The control device evaluates these messages as follows: the control device has a filter for identifying the first oncoming vehicle and its message and activates a warning system in the ego-vehicle to prevent-passing process if this message includes the information about the presence of a trailing vehicle.

17 Claims, 1 Drawing Sheet

(56) References Cited

U.S. PATENT DOCUMENTS

| | | | | |
|---|---|---|---|---|
| 2009/0248284 | A1 | 10/2009 | Yoshioka et al. | |
| 2015/0131637 | A1* | 5/2015 | Rubin | G08G 9/02 370/337 |

FOREIGN PATENT DOCUMENTS

| | | | |
|---|---|---|---|
| DE | 10 2012 005 245 | A1 | 9/2012 |
| DE | 10 2011 084 878 | A1 | 4/2013 |
| WO | WO 2006/037360 | A1 | 4/2006 |

* cited by examiner

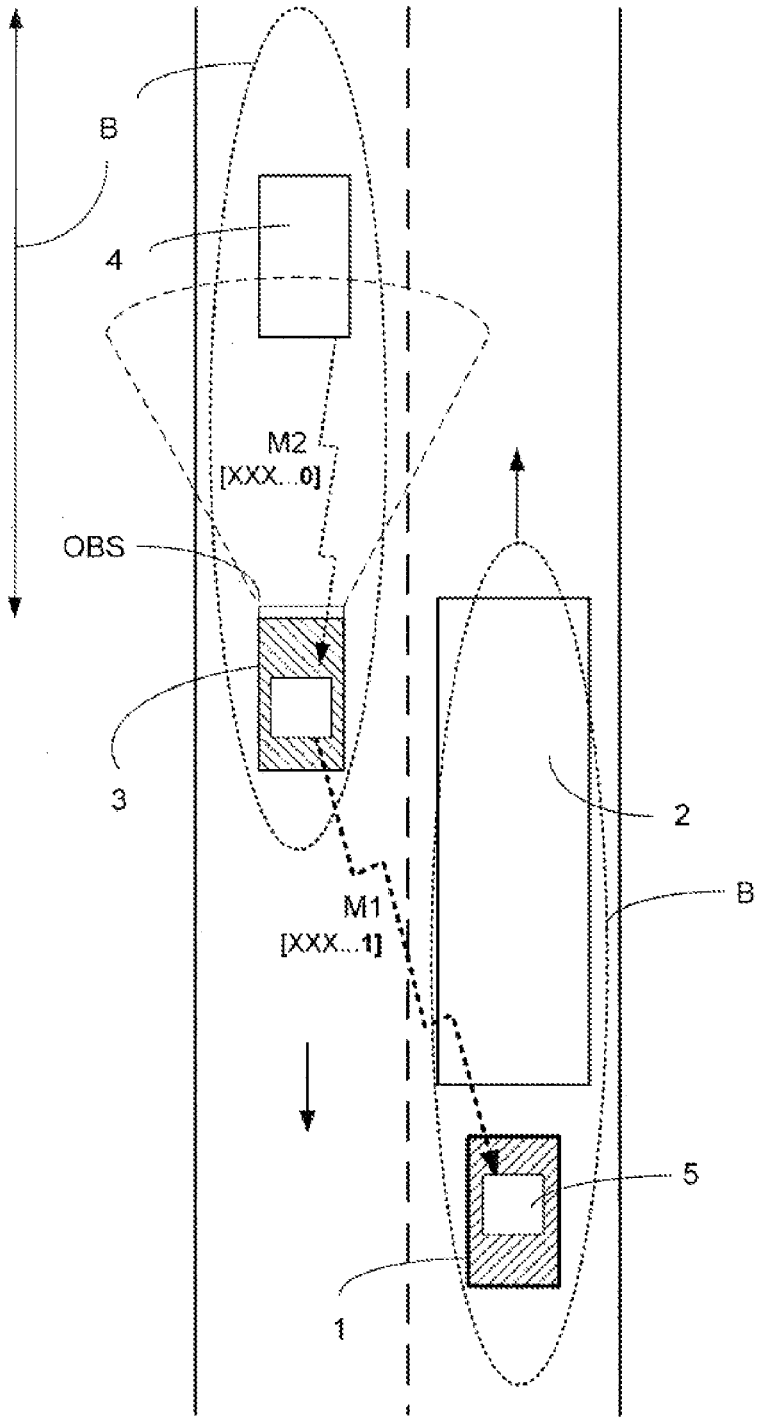
B
4
M2
[XXX...0]
OBS
3
2
B
M1
[XXX...1]
5
1

PASSING ASSISTANCE SYSTEM AND METHOD

CROSS REFERENCE TO RELATED APPLICATIONS

This application claims priority under 35 U.S.C. §119 from German Patent Application No. 10 2013 217 434.9, filed Sep. 2, 2013, the entire disclosure of which is herein expressly incorporated by reference.

BACKGROUND AND SUMMARY OF THE INVENTION

The invention relates in general to a passing assistance system. A passing assistance system, called "Dynamic Pass Prediction" (DPP) was developed by BMW research in or about 2005 through 2008. DPP is a system that provides the driver with information about current passing options. To execute this function, the system uses the ACC (adaptive cruise control) radar and known information about the vehicle dynamics and the driver's driving style, and in particular digital map data. Whereas in the past the courses of roads were the most important features for routine planning, now other information is also involved, such as for instance information about the street's geometry, curves, upward and downward slopes, crests, street width, visibility, and even the instantaneously advisable vehicle speed.

Navteq provides an example of this with its "Electronic Horizon." "Electronic Horizon" provides a preview of the up coming road segment with information that BMW's "Dynamic Pass Prediction" system, for instance, also uses. Using the information from the Electronic Horizon about curves, streets that flow into the current roadway, speed limits and stoplights ahead, the BMW system calculates whether a passing maneuver might be hazardous. If it would be, the driver receives a visual or acoustic warning to use the blinker.

Reference may be made to DE 10 2011 084 878 A1 and DE 10 2004 019 337 A1 for additional technical background.

The object of the invention is to create a system of the above-mentioned type that is to be even more reliable and advantageous.

This and other objects are achieved according to the invention by providing a passing assistance system in one's vehicle (referred to herein as the "ego-vehicle") that is equipped with an electronic control device for at least receiving messages from car-to-car communication systems of other vehicles. The messages include information about the presence or absence of a vehicle that trails the vehicle transmitting the message, at least in a certain detection range. The electronic control device evaluates these messages as follows: the control device has a filter for identifying the first oncoming vehicle and its message and activates warning systems in the ego-vehicle to prevent a passing process if this message includes the information about the presence of a trailing vehicle.

The term "car-to-car communication system" is used here in the broadest sense for any system via which vehicles can communicate with one another; the term is thus not limited to the so-called "car-to-car communication systems" with the known "802.11p" wireless transmission technology. Such a car-to-car communication system could also be realized, for instance, using a mobile network.

The electronic control device for the ego-vehicle is also preferably embodied for transmitting a message via a car-to-car communication system, wherein the message includes information about the presence or absence of a vehicle trailing the ego-vehicle. Thus, other vehicles may also be equipped with a corresponding passing assistance function.

In a preferred embodiment of the inventive passing assistance system, the information about the presence of a vehicle trailing the vehicle transmitting the message also includes the distance to the trailing vehicle.

The term ego-vehicle refers to the vehicle that includes the inventive passing assistance system.

The following additional considerations, information, and ideas underlie the invention.

The BMW DPP passing assistance system described in the foregoing does not evaluate any information about oncoming vehicles.

In a certain respect the invention represents a cooperative expanded passing assistance system in the context of a "passing prevention system" if it is currently not possible to pass safely. The invention is based on the known problem of a driver who has to "inch out" to see whether there is oncoming traffic and whether the geometry of the road permits safe passing.

With passing assistance systems based on wireless transmission technologies such as, for example, the "802.11p" in car-to-car communication systems (also known as C2C communication), the relatively short wireless range (200-600 m) limits its usefulness such that it cannot be realized in a reasonable manner.

The method described herein permits practical implementation of a passing assistance system in the context of a passing prevention assistance system based on wireless transmission technology with realistic prospects for appropriate modification of the standard (CAM, BSM, etc.) in car-to-car communication systems.

For example, in current standards, vehicles with a car-to-car communication system already transmit the position, direction, and speed of vehicles at approx. 200 to 600 m distance, depending on visual obstruction. However, it is precisely when trucks are to be passed that the visibility of the driver of the ego-vehicle is obstructed, generally unfortunately also at the same time there is a reduction in wireless transmission in the forward direction, since such transmission is also damped/shadowed by the truck. Therefore, the ego-vehicle does not receive the corresponding positions of oncoming vehicles until relatively late so that in many cases the passing prevention assistance system would not provide a red light because of a lack of data from oncoming vehicles. Consequently, the driver must himself veer out to see whether it is still not possible to pass.

This may be remediated for instance with the following inventive exemplary embodiment: the position information periodically transmitted by all vehicles equipped with car-to-car communication systems (e.g. "Here I am" message), known from the so-called CAM (EU Cooperative Awareness Message) or BSM (US Basic Safety Message) is preferably expanded by one bit. This bit is set, for example, to "0" when the vehicle does not have any information about a trailing vehicle in the same direction within the range of x meters (e.g. 300 m) (either based on the CAM transmitted by it or using other on-board sensor systems, such as radar, Parking Distance Control "PDC", camera, or lidar). The bit is set to "1" if at least one trailing vehicle is detected in the defined range of x meters.

If, in accordance with one preferred exemplary embodiment, the Privately Owned Vehicle (POV) that wants to pass now receives, for example, a CAM with a set bit ("1") from an oncoming vehicle that is 250 m away, it is known that another vehicle also follows in the next 300 m. Correspondingly, the passing assistance system can wait for another oncoming vehicle before it is necessary to check again whether it is safe to pass.

In one advantageous refinement, the distance to the next trailing vehicle may also be transmitted in the CAM. This would increase the utility of the system, but, depending on the resolution of the distance value, would require additional bits that would have to be transmitted.

Such a small and helpful modification to the standard would have a true possibility of being incorporated into the ETSI (EU) and/or SAE (US) standard. The utility of the passing assistance system may be increased by also incorporating on-board sensor systems.

In one advantageous refinement of the invention, a message with the information about the presence or absence of a vehicle trailing the ego-vehicle is not transmitted or received unless a passing situation may occur with at least a pre-defined probability. This probability may be determined, for instance, using data from a navigation system, according to which street type, intersections, city traffic, passing restrictions, etc. are known. In many cases this can reduce the transmission bandwidth.

The car-to-car communication system is preferably realized via wireless communication, wherein when there is a desire to pass, the ego-vehicle transmits a querying message that is receivable by at least the first oncoming vehicle, and wherein the first oncoming vehicle transmits, only in response to the query message, the message with the information about the presence or absence of a vehicle trailing the first oncoming vehicle. The ego-vehicle may transmit for instance its position, direction, and speed, in particular only when passing is potentially possible at all. If another vehicle (at least the first oncoming vehicle) receives the query message, that vehicle (at least the first oncoming vehicle) can calculate whether it is potentially in conflict with the transmitted desire to pass and whether the first oncoming vehicle can detect additional trailing vehicles. If that vehicle (at least the first oncoming vehicle) can, the first oncoming vehicle may activate a corresponding warning system, e.g. together with its own position, direction, track, and speed.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 is a schematic diagram illustrating an example of a passing situation in which the invention may be used to particular advantage.

DETAILED DESCRIPTION OF THE DRAWING

FIG. 1 depicts an ego-vehicle 1 with an electronic control device 5. The driver of the ego-vehicle 1 drives behind a truck 2 and wants to pass the truck 2. A vehicle 3 that is not yet visible to the driver of the ego-vehicle 1 is approaching in the next lane over. The vehicle 3 is trailed by a vehicle 4 that is within a certain detection range B.

At least the ego-vehicle 1 and the first oncoming vehicle 3 are each equipped with a car-to-car communication system. Using the latter, the first oncoming vehicle 3 transmits a first message M1, which the ego-vehicle 1 receives and evaluates.

In accordance with an embodiment of the invention, the message M1 is structured, and may be evaluated by the control device 5 of the ego-vehicle vehicle 1, such that in the control device 5 information may be determined as to whether a vehicle 4 trailing the first oncoming vehicle 3 is present, at least in the defined minimum detection range B.

In a particularly advantageous manner, at a specific location (in this case e.g. at the end) of the digital message M1, a bit is defined that includes the information about whether a trailing vehicle 4 is present [XXX . . . 1] or not [XXX . . . 0].

If this message extension is added to standard for car-to-car communication systems, this information may be transmitted and received by every vehicle with this system. For instance, in this case the vehicle 4 depicted here may also transmit a message M2—in this case [XXX . . . 0] —according to which no additional vehicle would be trailing this vehicle in its detection range.

Since, at least for an extended transition period, not all vehicles will be equipped with a car-to-car communication system, one vehicle, as in this case the vehicle 3 (with car-to-car communication system)—may check with other onboard sensor systems whether vehicle 3 is trailed by a vehicle 4 (if the vehicle 4 is not equipped with a car-to-car communication system).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A passing assistance system in an ego-vehicle, comprising:

an electronic control device that receives messages from car-to-car communication systems of other vehicles, wherein the electronic control device is programmed to:

evaluate received messages;

identify a first oncoming vehicle based on a received message from the first oncoming vehicle, the received message having a first portion and a second portion appended to the first portion, wherein the first portion includes information at least identifying the first oncoming vehicle and the second portion includes information indicating both a presence or an absence of a vehicle trailing the first oncoming vehicle; and activate a warning system in the ego-vehicle to prevent a passing process if the received message from the first oncoming vehicle that identifies the first oncoming vehicle includes information about the presence of the vehicle trailing the oncoming vehicle.

2. The passing assistance system according to claim 1, wherein the electronic control device is further programmed to transmit a message from a car-to-car communication system, said message including information about the presence or absence of a vehicle trailing the ego-vehicle.

3. The passing assistance system according to claim 1, wherein the information about the presence of a vehicle trailing the oncoming vehicle includes distance information to the trailing vehicle.

4. The passing assistance system according to claim 2, wherein the information about the presence of a vehicle trailing the oncoming vehicle includes distance information to the trailing vehicle.

5. The passing assistance system according to claim 2, wherein the message about the presence or absence of the vehicle trailing the ego-vehicle is not transmitted or received unless there is a predefined probability of a passing situation occurring.

6. The passing assistance system according to claim 1, wherein the car-to-car communication system is a wireless car-to-car communication system, and further wherein the ego-vehicle transmits a query message when there is a desire to pass, the query message being receivable by at least the first oncoming vehicle which, only in response to the query message, transmits the message with the information about the presence or absence of the vehicle trailing the first oncoming vehicle.

7. The passing assistance system according to claim 2, wherein the car-to-car communication system is a wireless car-to-car communication system, and further wherein the ego-vehicle transmits a query message when there is a desire to pass, the query message being receivable by at least the first oncoming vehicle which, only in response to the query message, transmits the message with the information about the presence or absence of the vehicle trailing the first oncoming vehicle.

8. The passing assistance system according to claim 3, wherein the car-to-car communication system is a wireless car-to-car communication system, and further wherein the ego-vehicle transmits a query message when there is a desire to pass, the query message being receivable by at least the first oncoming vehicle which, only in response to the query message, transmits the message with the information about the presence or absence of the vehicle trailing the first oncoming vehicle.

9. The passing assistance system according to claim 5, wherein the car-to-car communication system is a wireless car-to-car communication system, and further wherein the ego-vehicle transmits a query message when there is a desire to pass, the query message being receivable by at least the first oncoming vehicle which, only in response to the query message, transmits the message with the information about the presence or absence of the vehicle trailing the first oncoming vehicle.

10. A method of operating a passing assistance system in an ego-vehicle, the method comprising the acts of:

receiving, by an electronic control device of the ego-vehicle, messages from car-to-car communication systems of other vehicles;

evaluating, via the electronic control device, the received messages;

identifying a first oncoming vehicle based on a message from the first oncoming vehicle, the received message having a first portion and a second portion appended to the first portion, wherein the first portion includes information at least identifying the first oncoming vehicle and the second portion includes information indicating both a presence or an absence of a vehicle trailing the first oncoming vehicle; and activating, via the electronic control device, a warning in the ego-vehicle about a passing process if the message from the first oncoming vehicle that identifies the first oncoming vehicle includes information about the presence of the vehicle trailing the first oncoming vehicle.

11. The method according to claim 10, further comprising the act of:

transmitting, via the electronic control device, a message from the car-to-car communication system, said message including information about the presence or absence of a vehicle trailing the ego-vehicle.

12. The method according to claim 11, wherein the information from the first oncoming vehicle about the presence of a vehicle trailing the first oncoming vehicle includes distance information to the trailing vehicle.

13. The method according to claim 12, further comprising the act of:

transmitting, via the electronic control device, a query message in a passing situation, said query message being receivable by the first oncoming vehicle, wherein the first oncoming vehicle transmits the message with the information about the presence or absence of a trailing vehicle only in response to the query message.

14. The passing assistance system according to claim 1, wherein the presence of the vehicle trailing the first oncoming vehicle is indicated in the second portion of the received message if the vehicle trailing the first oncoming vehicle is in a predefined detection range.

15. The passing assistance system according to claim 14, wherein the presence of the vehicle trailing the first oncoming vehicle is indicated by one or more bits of the second portion of the received message.

16. The method according to claim 10, wherein the presence of the vehicle trailing the first oncoming vehicle is indicated in the second portion of the received message if the vehicle trailing the first oncoming vehicle is in a predefined detection range.

17. The method according to claim 16, wherein the presence of the vehicle trailing the first oncoming vehicle is indicated by one or more bits of the second portion of the received message.

* * * * *